US010040108B2

(12) United States Patent
Wines

(10) Patent No.: US 10,040,108 B2
(45) Date of Patent: Aug. 7, 2018

(54) TUBULAR STRUCTURE SUPPORT WITH VARIABLE DIMENSIONS AND MECHANICAL PROPERTIES

(71) Applicant: L & W Engineering, New Boston, MI (US)

(72) Inventor: Jim Wines, Palmyra, MI (US)

(73) Assignee: L&W Engineering, Belleville, MI (US)

( * ) Notice: Subject to any disclaimer, the term of this patent is extended or adjusted under 35 U.S.C. 154(b) by 141 days.

(21) Appl. No.: 14/837,326

(22) Filed: Aug. 27, 2015

(65) Prior Publication Data

US 2016/0084433 A1 Mar. 24, 2016

Related U.S. Application Data

(60) Provisional application No. 62/052,277, filed on Sep. 18, 2014.

(51) Int. Cl.

| | |
|---|---|
| ***B21C 1/24*** | (2006.01) |
| ***B21C 3/06*** | (2006.01) |
| ***B21C 1/22*** | (2006.01) |
| ***B21C 3/16*** | (2006.01) |
| *B21C 37/16* | (2006.01) |

(52) U.S. Cl.

CPC ..... *B21C 3/06* (2013.01); *B21C 1/22* (2013.01); *B21C 1/24* (2013.01); *B21C 3/16* (2013.01); *B21C 37/16* (2013.01)

(58) Field of Classification Search

CPC .... B21C 3/06; B21C 1/22; B21C 1/24; B21C 3/16; B21C 37/16

USPC ..... 72/276, 283, 370.14

See application file for complete search history.

(56) References Cited

U.S. PATENT DOCUMENTS

| | | | | |
|---|---|---|---|---|
| 2,228,301 | A * | 1/1941 | Ditzel | B21C 1/24 72/276 |
| 3,837,205 | A * | 9/1974 | Simon | B21C 23/14 72/260 |
| 5,119,662 | A | 6/1992 | Sunaga et al. | |
| 6,523,385 | B2 * | 2/2003 | Hausler | B21C 1/24 72/121 |
| 7,484,298 | B2 * | 2/2009 | Mellas | B21C 37/065 29/421.1 |
| 7,752,728 | B2 * | 7/2010 | Schedler | B23K 20/085 138/155 |
| 8,141,404 | B2 | 3/2012 | Newport et al. | |
| 8,245,734 | B2 | 8/2012 | Jahani et al. | |
| 2006/0112558 | A1 | 6/2006 | Lorenz et al. | |

(Continued)

*Primary Examiner* — Gwendolyn W Baxter

(74) *Attorney, Agent, or Firm* — Fishman Stewart PLLC

(57) ABSTRACT

A support may include a hollow metallic tube extending over an axis and may include two opposing ends. The tube may include a plurality of sections disposed along the axis. A first section may be disposed at an end of the tube and include a first inner diameter, a first outer diameter, and a first wall thickness. A second section may be separated from the first section via a first transition zone. The second section may include a second inner diameter, a second outer diameter, and a second wall thickness. A third section may be disposed remote from the first section and be separated from the second section via a second transition zone. The third section may have a third inner diameter, a third outer diameter, and a third wall thickness. The wall thickness, inner diameter and outer diameter may vary along the tube between the plurality of sections.

18 Claims, 4 Drawing Sheets

(56) References Cited

U.S. PATENT DOCUMENTS

| | | | | |
|---|---|---|---|---|
| 2008/0115553 | A1* | 5/2008 | Brochheuser | B21C 1/24 72/283 |
| 2011/0062155 | A1* | 3/2011 | Walther | B21D 26/033 220/86.2 |
| 2011/0290364 | A1* | 12/2011 | Biris | B21C 23/002 138/140 |

* cited by examiner

TUBULAR STRUCTURE SUPPORT WITH VARIABLE DIMENSIONS AND MECHANICAL PROPERTIES

CROSS-REFERENCE TO RELATED APPLICATIONS

This application claims priority to U.S. Provisional Patent Application No. 62/052,277, filed Sep. 18, 2014, the contents of which are hereby incorporated in its entirety.

TECHNICAL FIELD

The present disclosure relates generally to a tubular structure support, and more particularly to a tubular structure support with variable dimensions and mechanical properties.

BACKGROUND

Structural supports, such as metal tubes, are hollow tubes that are used in a variety of applications. For example, some applications may include, but not limited to, structural components for vehicles, industrial equipment, building, infrastructural and architectural components, commercial and residential components, road guard rails and light posts, to name a few. As a specific example, an important aim of the automotive industry is to decrease fuel consumption by reducing the weight of the vehicle without sacrificing safety. It is preferred that the vehicle structure supports be lightweight to provide improved fuel economy. However, structure supports such as those applicable for vehicles preferably have properties of high strength to satisfy the strict standards of crash worthiness and thereby maintain the structural integrity of the vehicle.

Tubular structure supports may be produced by two distinct processes that may result in either a seamless or welded support. Raw metal, such as steel, is first cast into a workable starting form, and is made into a tubular blank by working the raw metal into a seamless tube or forcing the edges together and sealing them with a weld. The blank may then be formed into the structure support, for example via cold-working, warm-working, hot-working or a combination thereof.

In certain applications, it may be desirable that the finished structure support has variable dimensions such as wall thickness, inner diameter and outer diameter in an attempt to reduce the overall mass of the structure support or reduce the cost of materials used to form the component. For example, a structure support may have localized reinforcing of support sections via increased wall thickness in regions of high loads to compensate for increased strength demands. Additionally or alternatively, the structure support may include different internal or external diameters optimized to define a desired cross-sectional shape. Yet, the desirability of such conventional structure supports is limited in many respects. In one aspect, the increase in strength correlates to an increase in mass or wall thickness, which may not only contribute to an increase in overall mass but may also sacrifice the structural integrity of the structure support in regions of decreased wall thickness. In another aspect, manufacturing costs are significantly increased due to preforming and/or post-forming steps required to achieve a structure support with desirable dimensions and mechanical properties.

Accordingly, conventional structure supports and metal-working processes force a tradeoff between costs, mass savings and strength.

Overcoming these concerns would be desirable and could save the industry substantial resources.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

Figure 1:
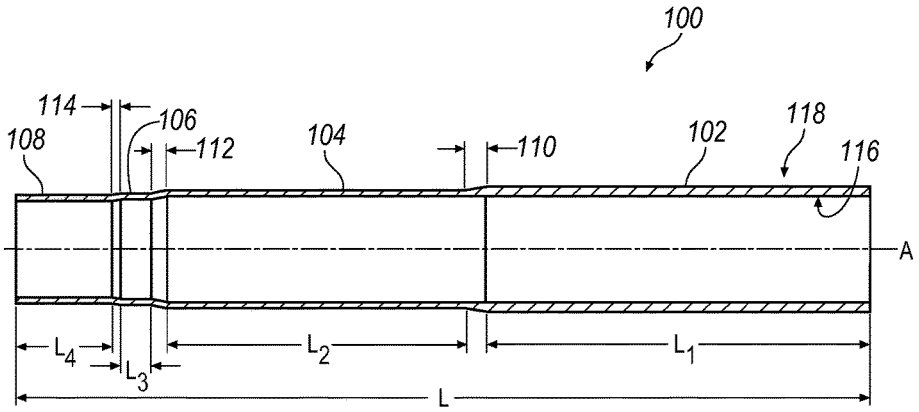
FIG. 1 illustrates a plan cross-sectional view of an exemplary tubular structure support including a plurality of sections of varying length.

A product for a tubular structural support and a method for its production are disclosed. More particularly, a tubular structure support and method for its production relate to a plurality of variable dimensions and mechanical properties without requiring costly pre-forming or post-forming processes. The tubular structure support may include a plurality of sections that may differ in dimensions including but not limited to wall thickness, inner diameter, outer diameter and length, and mechanical properties including but not limited to strength (e.g., as contemplated to include tensile strength, yield strength and specific strength), surface finish and hardness, or any combination thereof as between sections. A transition zone may be disposed between at least two of the plurality of sections. The transition zone may offset the differences in dimensions between the various sections. For example, the transition zone may provide a smooth, gradual transition of wall thickness, inner diameter, outer diameter, or a combination thereof between two adjacent sections. These gradual changes in dimensions between sections may reduce stress levels in the transition zones and facilitate the reduction of the overall stress in the structure support. The transition zone may also reduce the risk of failure of the structure support resulting from dissimilar strengths between sections. According to one illustration, the wall thickness, inner diameter, outer diameter, strength, surface finish, hardness or some subset of the foregoing are generally constant along the length of each individual section except at the transition zone between adjacent sections. For example, each section may include an inner surface and an outer surface that extend substantially parallel to the longitudinal axis of the structure support, and the transition zone may include at least one of the inner surface and the outer surface extending obliquely to the longitudinal axis.

The tubular structure support may demonstrate exceptional strength and reduced overall mass with a resulting material savings. The process used for its production has advantages with respect to mass, surface finish, strength and overall structural integrity (e.g., resistance to failure) as will be described in more detail below. Unlike conventional structure supports, the exemplary tubular structure support disclosed herein includes greater strength in sections of reduced dimensions in relation to sections having greater dimensions, and as such the overall mass of the structure support is reduced while maintaining exceptional resistance to stresses and failure. The increase in strength may be derived from a series of forming steps that reduce the dimensions (e.g., including at least one of outer diameter, inner diameter and wall thickness) in successive sections of the structure support. Additionally, the costs associated with manufacturing the structure support are reduced since the process for its production may achieve the desired variable dimensions and mechanical properties in a single operation without the necessity of expensive post-forming steps, e.g., heat treatment, machining and surface finishing to name a few. The material and dimensions of the sections and transition zones may be selected to fit a particular application. The selected material may be homogenous throughout the structure support. According to one illustration, the tubular structure support may include a hollow metallic tube having two opposing ends and a plurality of metallic sections extending over a length of the tube with respect to a longitudinal axis, and each of the sections may include varying dimensions and mechanical properties. For example, the mechanical properties including surface finish, hardness and strength of each section may increase with a correlating decrease in the dimensions including outer diameter, inner diameter and wall thickness of the respective sections. Accordingly, the exemplary tubular support and the process used for its production have advantages with respect to mass, strength, surface finish and manufacturing costs.

The following discussion is but one non-limiting example of an improved tubular structure support, for example that may be integrated into a structural assembly, and a process for producing the same. As contextual examples, the structure support may be integrated into various structures and used in various applications including, but not limited to, vehicle frames, sub-frames and chassis, vehicle door assemblies, carriage frames, shelter frames (moveable and fixed), instrument panel reinforcements, furniture frames, residential and commercial structure frames, infrastructure, road rails and light post to name a few. It will be appreciated that a vehicle applies broadly to an object used for transporting people and/or goods by way of at least one of land, air, space and water.

FIG. 1 illustrates an exemplary tubular structure support 100 (otherwise referred to as "structure support") having four sections 102, 104, 106, 108 of varying length. Although four sections 102, 104, 106, 108 are shown, more or less than four sections of varying dimensions and mechanical properties may be provided. The structure support 100 may have transition zones 110, 112, 114 disposed between adjacent sections to compensate for varying dimensions, e.g., length, wall thickness, inner diameter and outer diameter, and compensate for varying mechanical properties, e.g., strength, hardness, elongation, and surface finish, between the respective sections 102, 104, 106, 108 of the support 100.

According to one implementation, the structure support 100 may be formed from a starting workpiece or blank of a single piece of tubing (e.g., seamless or welded). The blank may have generally constant dimensions and mechanical properties across the length of its longitudinal axis, and then may be subsequently formed into the structure support 100 having desired dimensions and mechanical properties according to predetermined specifications. The structure support 100 may be formed from many different materials, including but not limited to metals such as steel, iron, black (lacquer) steel, stainless steel, carbon steel, alloy steel, galvanized steel, brass, aluminum, and copper to name a few. In particular, a high-strength low-alloy steel may be a desirable material to form the structure support 100 due to a wide range of mechanical properties within this grade of material, such as strength, toughness, formability and atmospheric corrosion resistance. The structure support 100, including the various sections and transition zones, may include an inner surface 116 and a radially outer surface 118 relative to the longitudinal axis A. Although the material of the structure support 100 may be homogenous, the sections and transition zones may vary in the surface finish, strength and hardness, as will be described in more detail below.

As illustrated in FIG. 1, the structure support 100 may include four sections 102, 104, 106, 108 extending along the longitudinal axis A. The structure support 100 may include a first section 102 disposed at one end, a second section 104, a third section 106 and a fourth section 108 disposed at the other end of the structure support 100 opposite the first section 102. The respective sections 102, 104, 106, 108 may include a transition zone 110, 112, 114 disposed between two adjacent sections. For example, a first transition zone 110 may be disposed between the first section 102 and the second section 104, a second transition zone 112 may be disposed between the second section 104 and the third section 106, and a third transition 114 may be disposed between the third section 106 and the fourth section 108. The transition zones 110, 112, 114 may provide a gradual transition between sections of varying dimensions and mechanical properties and thereby reduce the level of stresses in the structure support 100. According to one implementation, each section 102, 104, 106, 108 may have varying lengths $L_1$, $L_2$, $L_3$, $L_4$, respectively, that may depend on a particular application and the desired properties of the material. For instance, the lengths $L_1$, $L_2$, $L_3$ and $L_4$ may be based on the desired load bearing abilities, rigidity and/or mass of the structure support 100. Accordingly, it may not be necessary for $L_1$ to be greater than $L_3$ as illustrated in FIG. 1, for example. As will be described in more detail below, the length of the transition zones 110, 112, 114 may depend on the wall thickness, inner diameter, outer diameter, or a combination thereof between two adjacent sections.

Figure 2:
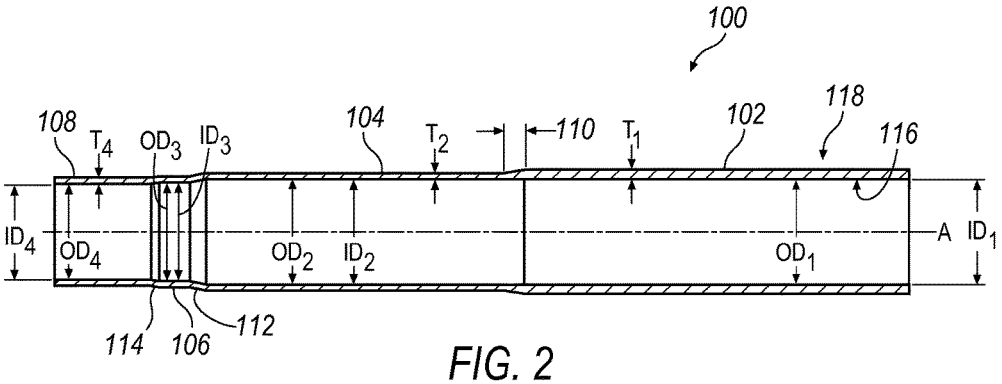
FIG. 2 illustrates a plan cross-sectional view of the structure support of FIG. 1 having variable wall thickness, variable inner diameter and variable outer diameter, while each section defines a wall thickness, an inner diameter and an outer diameter that is generally constant for that section except at a region of transition between adjacent sections.

As can be seen in FIG. 2, each of the sections 102, 104, 106, 108 of the exemplary tubular support 100 includes varying dimensions and mechanical properties such as inner diameter, outer diameter, wall thickness, strength (e.g., including tensile, yield and specific strength), surface finish and hardness, for example. The wall thickness may be defined by the difference between the inner diameter and the outer diameter of the structure support 100 at corresponding points along the longitudinal axis A, or stated alternatively the wall thickness represents a radial extent of the wall between the inner diameter and the outer diameter.

Pursuant to one exemplary approach, the first section 102 may have a first outer diameter $OD_1$ that is the largest along the structure support 100, while having a first inner diameter $ID_1$ that may be substantially equal to a second inner diameter $ID_2$ of the second section 104. The first section 102 may have a first wall thickness $T_1$ of a larger gauge than the remaining sections 104, 106, 108 of the structure support 100. The first wall thickness $T_1$, the first outer diameter $OD_1$ and the first inner diameter $ID_1$ may be substantially uniform or constant along the first section, subject to tolerance considerations.

The second section 104 may have a second outer diameter $OD_2$ smaller than the first outer diameter $OD_1$ of the first section 102. As mentioned above, the second inner diameter $ID_2$ of the second section 104 may be equal to the first inner diameter $ID_1$ of the first section 102, subject to tolerance considerations. Accordingly, the second section 104 may have a second wall thickness $T_2$ less than the first wall thickness $T_1$ of the first section 102. The inner diameter $ID_2$ of the second section 104 may have a greater dimensional accuracy that does not vary substantially throughout the length $L_2$ (e.g., as illustrated in FIG. 1) than the inner diameter $ID_1$ of the first section 102. The inner surface finish of the second section 104 may be smoother than the inner surface finish of the first section 102. The inner surface finish may be influenced at least in part by controlling the inner diameter and outer diameter of the structure support 100 during forming to achieve the desired dimensions on the inner surface 116 and outer surface 118. The second section 104 may have a greater strength than the strength of the first section 102, for example by way of further metal working (e.g., cold forming) on the second section 104 to decrease the second outer diameter $OD_2$ relative to the first outer diameter $OD_1$.

The first transition zone 110 disposed between the first section 102 and the second section 104 may have an angled outer surface 118 to account for the differing outer diameters $OD_1$, $OD_2$ of the first and second section 102, 104, respectively. However, the inner surface 116 of the first transition zone 110 may be generally planar with the first and second sections 102, 104, and the inner surface 116 of the first transition zone 110 may only be differentiated from the inner surface 116 of the first and second sections 102, 104 by visual cues. As such, the inner diameter at the first transition zone 110 may be equal to the inner diameter $ID_1$ of the first section 102 and the inner diameter $ID_2$ of the second section 104. Thus, the first transition zone 110 may have a generally triangular cross-section.

The third section 106 of the structure support 100 may have a third outer diameter $OD_3$ that is smaller than the outer diameter $OD_2$ of the second section 104 and the outer diameter $OD_1$ of the first section 102. Moreover, the third section 106 may have a third inner diameter $ID_3$ that is smaller than the inner diameter $ID_2$ of the second section 104. Pursuant to one example, the reduction of the third outer diameter $OD_3$ and the third inner diameter $ID_3$ may be approximately equal to one another. Accordingly, the third section 106 may have a third wall thickness $T_3$ equal to the second wall thickness $T_2$ of the second section 104, subject to tolerance considerations, and therefore the third wall thickness $T_3$ is less than the first wall thickness $T_1$ of the first section 102. The inner surface finish of the third section 106 may be of at least equal quality as the inner surface finish of the second section 104. The third section 106 may have a greater strength than the strength of the first section 102 and the second section 104. The increase in strength of the third section 106 in relation to the second section 104 and the first section 102 may be derived from working the tube to reduce the inner diameter $ID_3$ and the outer diameter $OD_3$ that may promote movement and propagation of dislocations of grain boundaries in the material's crystalline structure (e.g., strain hardening).

The second transition zone 112 is disposed between the second section 104 and the third section 106. The inner surface 116 and the outer surface of the second transition 112 may each extend at an angle with respect to the longitudinal axis A to account for the differing inner diameters $ID_2$, $ID_3$ and outer diameters $OD_2$, $OD_3$ between the second section 104 and the third section 106. These angled portions of the second transition zone 112 may be equal offsets of each other, and as such the second transition zone 112 may define an inner diameter and an outer diameter gradually decreasing from the second section 104 to the third section 106. The second transition zone 112 may therefore have a constant cross-section from the second section 104 to the third section 106, e.g., the inner surface and the outer surface of the second transition zone 112 may extend substantially parallel to each other and obliquely to the longitudinal axis A of the support structure 100. Accordingly, the second transition zone 112 may have a rectangular cross-section according to the example in FIG. 2.

The fourth section 108 may have a fourth outer diameter $OD_4$ that is the smallest of the structure support 100 as illustrated in FIG. 2, e.g., the fourth outer diameter $OD_4$ is less than the third outer diameter $OD_3$. The fourth section 108 may also have the smallest inner diameter $ID_4$ of the structure support 100, and as such defines a fourth inner diameter $ID_4$ of the fourth section 108 may be less than the inner diameter $ID_3$ of the third section. According to one example, the fourth section 108 may have a fourth wall thickness $T_4$ that may be similar to the second wall thickness $T_2$ of the second section 104 and the third wall thickness $T_3$ of the third section 106. The inner surface finish of the fourth section 108 may be at least equal to the inner surface finish of the second and third section 104, 106, with a similar increase in dimensional accuracy of the fourth inner diameter $ID_4$ relative to the first inner diameter $ID_1$. The strength of the fourth section 108 may be greater than the strength of the third section 106. As with the third section 106, the increased strength of the fourth section 108 may be derived from strain hardening by further reducing the fourth inner diameter $ID_4$ and fourth outer diameter $OD_4$ with respect to the third inner diameter $ID_3$ and the third outer diameter $OD_3$.

The third transition zone 114 may be disposed between the third section 106 and the fourth section 108. As with the second transition zone 112, the third transition zone 114 may include an angled inner surface 116 and outer surface 118 to make up for the difference of the dissimilar inner diameters $ID_3$, $ID_4$ and outer diameters $OD_3$, $OD_4$ between the third section 106 and the fourth section 108. Accordingly, the third transition zone 114 may have a generally uniform cross-section, e.g., a rectangular cross-section with substantially parallel inner and outer surfaces 116, 118 extending obliquely to the longitudinal axis A and gradually decreasing inner and outer diameters.

The length of the transition zones 110, 112, 114 may depend at least in part on the difference in wall thickness, inner diameter and/or outer diameter between adjacent sections of the structure support 100. For example, the larger the difference between the inner diameters $ID_2$, $ID_3$ and/or outer diameters $OD_2$, $OD_3$ between the second section 104 and the third section 106, then the length of the second transition zone 112 disposed between with second section 104 and the third section 106 may correspondingly increase, and vice versa.

Referring to FIGS. 3A-3D, a series of plan cross-sectional views illustrating the sequential manufacturing steps of the exemplary tubular structure support 100 are provided according to one example. According to the example, an initial tubular blank 200 is formed into the exemplary tubular structure support 100 via a series of forming steps that may include working (e.g., cold working, warm working) the blank 200 through a working apparatus 300. The series of forming steps may be continuous or discrete stages. The working apparatus 300 may include one or more inner tools 302 disposed concentrically within the blank 200 and at least one outer tool 304 disposed about the outer perimeter of the blank 200. The inner tool 302 may include, for example, at least one of a mandrel and a plug shaped and sized to permit its insertion into the blank 200. The inner tool 302 may be floating, stationary, semi-floating or a combination thereof. The inner tool 302 may be controlled in relation to the outer tool 304 via a control device, friction and/or tool design. The outer tool 304 may include, for example, a die, rollers and/or disks that may receive and deform the blank 200. As will be appreciated from FIGS. 3A-3D, the initial tubular blank 200 is never cut into separate processing sections, e.g., as between sections 102, 104, 106 and 108, and thus does not require subsequent mechanical or material joining methods. It will also be appreciated that the same inner tool 302 and/or outer tool 304 may be used in at least two of the steps, a different inner tool 302 and/or outer tool 304 may be used in the respective steps, or a combination thereof.

Figure 3A:
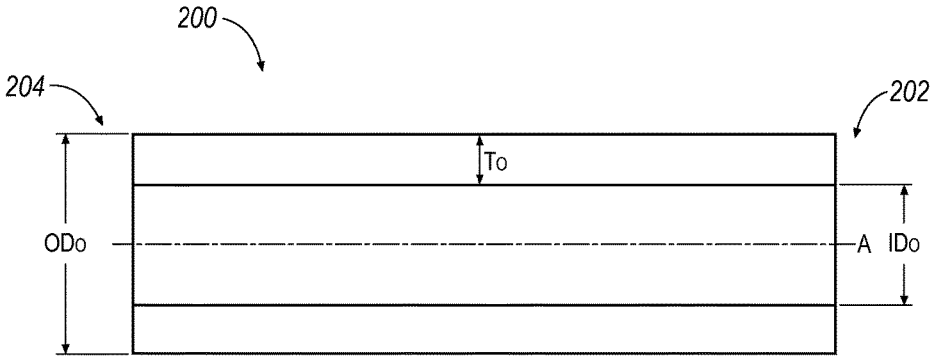
FIG. 3A illustrates a plan cross-sectional view of an exemplary tubular blank from which the exemplary structure support in FIGS. 1 and 2 is formed.

According to FIG. 3A, a tubular blank 200 is provided with a first end 202 and a second end 204. The blank 200 defines an initial inner diameter $ID_O$, an initial outer diameter $OD_O$, and an initial wall thickness $T_O$, each of which is generally constant and uniform along the length L with respect to the longitudinal axis A. The initial wall thickness $T_O$ may be greater than or equal to the first wall thickness $T_1$ of the final structure support 100 as illustrated in FIGS. 1-2.

Figure 3B:
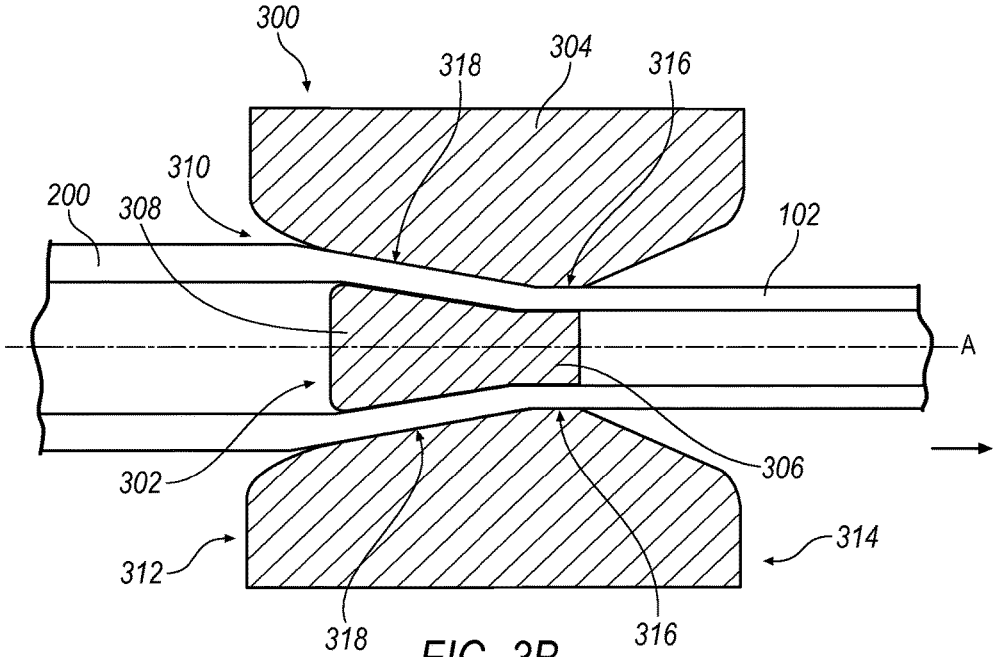
FIG. 3B illustrates a plan cross-sectional view of a working apparatus working on the tubular blank of FIG. 3A to form at least one section of the tubular structure support according to FIGS. 1 and 2.

Referring to FIG. 3B, the blank 200 may be placed into the working apparatus 300 to form the structure support 100. The inner tool 302 may include a generally cylindrically shaped head 306 and, according to the illustrated example, a body 308 that tapers towards the head 306. Additionally or alternatively, the inner tool 302 may define a constant diameter along its longitudinal length. The outer tool 304 may include an orifice 310 with a diameter decreasing gradually from an entry side 312 toward an exit side 314 with respect to the direction in which the tube is drawn as indicated by the arrow. That is, the outer tool 304 may include a first surface 316, otherwise referred to as a bearing surface, that may define a substantially circular and uniform diameter, and a second surface 318 that may decrease in diameter from the entry side 312 of the outer tool 304 towards the first surface 316. Additionally or alternatively, the outer tool 304 may include a transition surface (not shown) for directing the outer wall of the blank 200 radially inwards with respect to the longitudinal axis A during the step of forming the transition zone(s) 110, 112, 114, for example. According to another example, the orifice 310 of the outer tool 304 may define a generally constant diameter.

Still referring to FIG. 3B, the first end 202 of the blank 200 may be fed into the orifice 310 of the outer tool 304 and the inner tool 302 may be inserted into the hollow blank 200. The outer diameter of the head 306 may be constant and correspond to the inner diameter $ID_1$ of the first section 102 of the structure support 100. The inner diameter defined by the first surface 316 of the outer tool 304 may correspond to the outer diameter $OD_1$ of the first section 102 of the structure support 100. The blank 200 is advanced in a drawing direction as indicated by the arrow and the head 306 of the inner tool 302 is positioned substantially in alignment with the first surface 316 of the outer tool 304. As the blank 200 progresses in the drawing direction, at least one of compressive stresses and tension stresses act on the material to plastically deform the blank 200 resulting in the first section 102 of the support structure 100. The inner diameter $ID_O$ of the blank 200 conforms to the outer diameter of the head 306 and the outer diameter $OD_O$ of the blank 200 is reduced by the first surface 316 of the outer tool 304. The offset or difference between the inner diameter $ID_1$ and the outer diameter $OD_1$ of the first section 102 exiting the working apparatus 300 may define the first wall thickness $T_1$ that is less than the initial wall thickness $T_O$ of the blank 200 causing the material to stretch and draw. As such, the strength of the first section 102 may be greater than the initial strength of the blank 200 due to the dislocation of grain boundaries to obtain permanent distortions in the crystalline structure of the material (e.g., plastic deformation). The blank 200 may be advanced a predetermined length corresponding to the length $L_1$ of the first section 102. The resulting inner diameter $ID_1$, outer diameter $OD_1$, and wall thickness $T_1$ of the first section 102 may be generally constant and uniform across the length $L_1$.

Figure 3C:
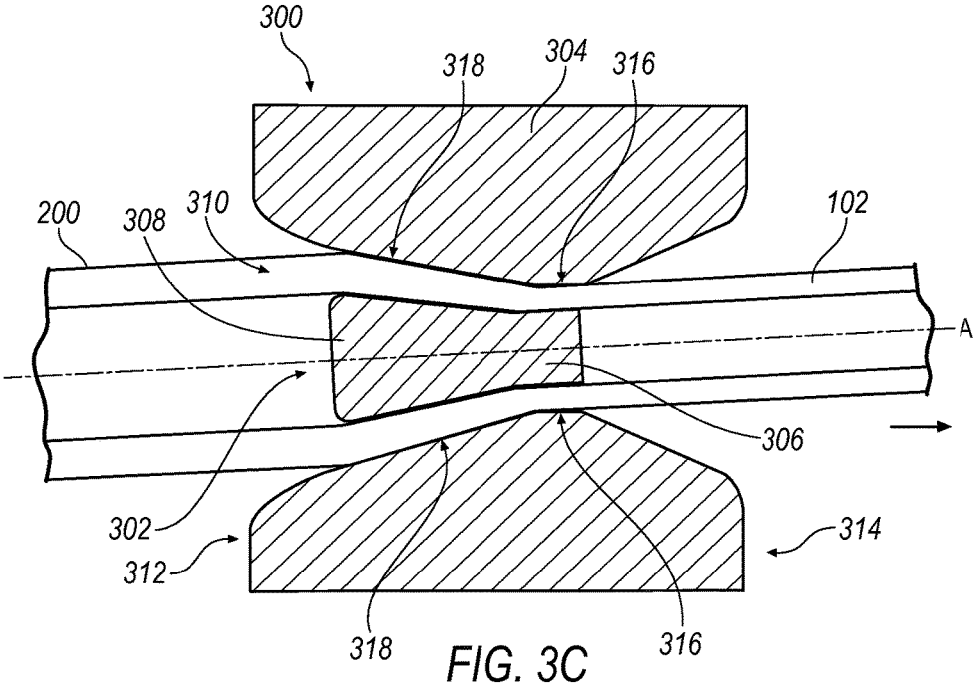
FIG. 3C illustrates a plan cross-sectional view of a working apparatus working on the tubular blank of FIG. 3A to form at least one exemplary transition zone of the tubular structure support according to FIGS. 1 and 2.

Referring to FIG. 3C, the outer diameter of the blank 200 may be further reduced via forming the first transition zone 110 to ultimately compensate for the difference in outer diameters $OD_1$, $OD_2$ between the first and second section 102, 104 of the final structure support 100, respectively. According to the illustrated example in FIG. 3C, the inner tool 302 may define the same dimensions as the inner tool 302 in FIG. 3B (e.g., the head 306 and body 308 may include equal outer diameters), and the inner diameter of the orifice 310 of the outer tool 304 may be equal to or less than the inner diameter of the orifice 310 in FIG. 3B.

The first transition zone 110 may be formed by manipulating at least one of the inner tool 302 and the blank 200 in relation to the outer tool 304. For example, as shown in FIG. 3C the blank 200 may be wedged or pivoted transversely to the drawing direction as indicated by arrow 320 in a reciprocating manner on the first surface 316 of the outer tool 304 to extend obliquely to the drawing direction. Optionally, the blank 200 may be rotated in the circumferential direction about the longitudinal axis A simultaneous with or in addition to the pivoting action to ensure a uniform and gradual decrease in the outer diameter of the blank 200 in the region corresponding to the first transition zone 110. The pivoting action increases the angle at which the blank 200 transverses through the orifice 310 and forces the outer surface of the blank 200 radially inwards towards the longitudinal axis A to gradually reduce the outer diameter of the support structure 100 along the first transition zone 110. Additionally or alternatively, the outer tool 304 may include a transition surface (not shown) that may direct the outer surface of the blank 200 radially inwards with respect to the longitudinal axis A to gradually reduce the outer diameter of the support structure 100. The inner tool 302 may remain stationary with respect to the outer tool 304 to maintain a constant inner diameter along the first transition zone 110. The inner tool 302 and the outer tool 304 may each act on the blank 200 as it transverses the orifice 310. Accordingly, the first transition zone 110 may define a triangular cross-section with respect to the longitudinal axis A, and thus the wall thickness of the structure support 100 along the first transition zone 110 may decrease from the first section 102 to the second section 104.

After forming the first transition zone 110, the blank 200 undergoes further drawing and stretching to form the second section 104, e.g., similar to FIG. 3B. The orifice 310 of the outer tool 304 has a reduced diameter thereby decreasing the outer diameter $OD_2$ of the second section 104 in relation to the outer diameter $OD_1$ of the first section 102 as the blank 200 exits from the working apparatus 300. As discussed previously, the inner diameter $ID_2$ of the second section 104 may be substantially equal to the inner diameter $ID_1$ of the first section 102, and therefore the inner tool 302 may have the same dimensions as the inner tool 302 used to form the first section 102 and/or the first transition zone 110. As such, the wall thickness $T_2$ of the second section 104 is less than the wall thickness $T_1$ of the first section 102. Additionally, the second section 104 may include a greater strength and a better surface finish as compared to the first section 102 owing at least in part to the increase of force applied to the blank 200 via the reducing outer tool 304. The blank 200 is advanced a predetermined length corresponding to the length $L_2$ of the second section 104.

Figure 3D:
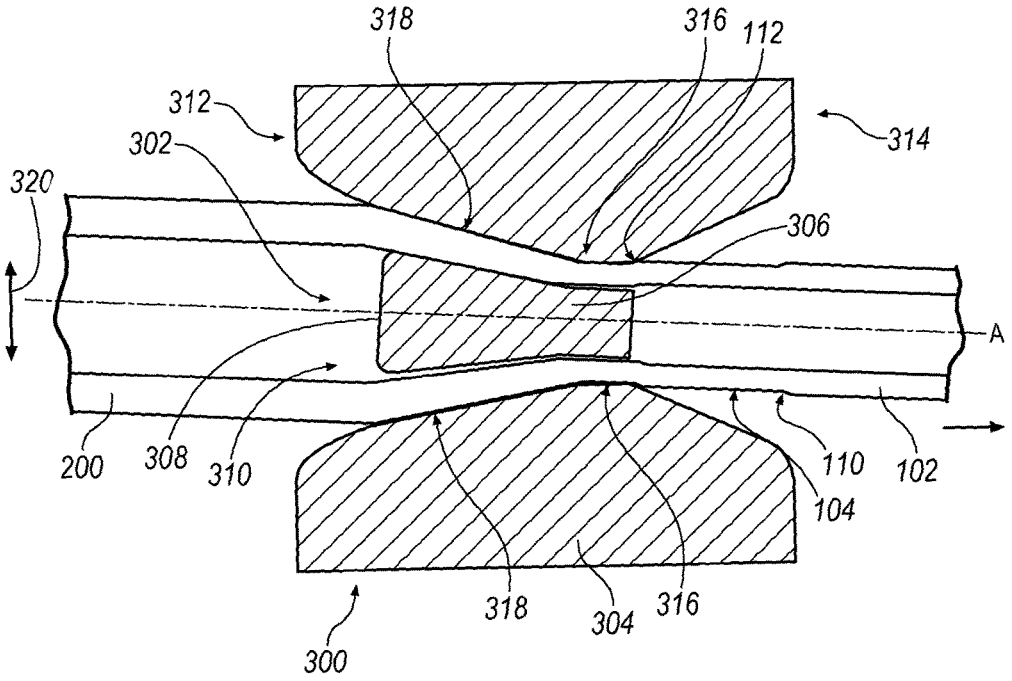
FIG. 3D illustrates a plan cross-sectional view of a working apparatus working on the tubular blank of FIG. 3A to form at least one other exemplary transition zone of the tubular structure support according to FIGS. 1 and 2.

FIG. 3D illustrates an exemplary step for forming at least one of the second transition zone 112 and the third transition zone 114. Each of the second transition zone 112 and the third transition zone 114 according to the examples illustrated in FIGS. 1 and 2 compensate for differing inner diameters and outer diameters as between adjacent sections 104, 106, 108. To form at least one of the second transition zone 112 and the third transition zone 114, the inner tool 302 may be manipulated transversely to the longitudinal axis A in relation to at least one of the blank 200 and the outer tool 304 as indicated by arrow 320. Additionally or alternatively, the blank 200 may be manipulated transversely to the drawing direction in relation to the outer tool 304 as indicated by arrow 320. According to FIG. 3D, the inner tool 302 may be simultaneously manipulated along the arrow 320 and the blank 200 may be manipulated along the arrow 320 to reduce the inner diameter and the outer diameter between the second section 104 and the third section 106, and/or between the third section 106 and the fourth section 108.

Pursuant to one example, the second transition zone 112 may be formed with an inner tool 302 having a head 306 defining an outer diameter corresponding to less than the inner diameter $ID_2$ of the second section 104, and an outer tool 304 having a first surface 316 defining an inner diameter corresponding to less than the outer diameter $OD_2$ of the second section 104. Additionally or alternatively, the third transition zone 114 may be formed with an inner tool 302 having a head 306 defining an outer diameter corresponding to less than the inner diameter $ID_3$ of the third section 106, and an outer tool 304 having a first surface 316 defining an inner diameter corresponding to less than the outer diameter $OD_3$ of the third section 106.

Once the second transition zone 112 is formed, the blank 200 is fed into an outer tool 304 including a first surface 316 defining an inner diameter corresponding to the outer diameter $OD_3$ of the third section 106 and an inner tool 302 is inserted into the blank 200, e.g., similar to FIG. 3B. The inner tool 302 includes a head 306 defining an outer diameter corresponding to the inner diameter $ID_3$ of the third section 106. Similarly, once the third transition zone 114 is formed, the blank 200 is fed into an outer tool 304 including a first surface 316 defining an inner diameter corresponding to the outer diameter $OD_4$ of the fourth section 108, and an inner tool 302 is inserted into the blank 200 having a head 306 defining an outer diameter corresponding to the inner diameter $ID_4$ of the fourth section 108.

As the blank 200 progress through the series of forming stages as described above, each resulting section 102, 104, 106, 108 of the structure support 100 may include varying dimensions and mechanical properties. Unlike conventional forming processes, the structure support 100 includes a greater strength in sections with reduced dimensions as compared to sections with increased dimensions. Accordingly, the strength of the structure support 100 increases while the dimensions decrease thereby having advantages with respect to mass savings and consequently saving of cost of materials. The transition zones 110, 112, 114 disposed between adjacent sections 102, 104, 106, 108 may reduce overall stresses in the structure support 100 and provide a gradual transition between sections of varying mechanical properties such as strength, hardness, surface finish, etc.

As best appreciated in FIGS. 3A-3D, the forming process has advantages with respect to material waste as compared to conventional processes due to the increase in dimensional accuracy in successive sections 102, 103, 106, 108, which savings may be amplified when using expensive materials. Further, the production cycle is relatively short compared to conventional processes without requiring costly and time consuming pre-forming and post-forming steps to achieve the variable dimensions and mechanical properties.

Figure 4:
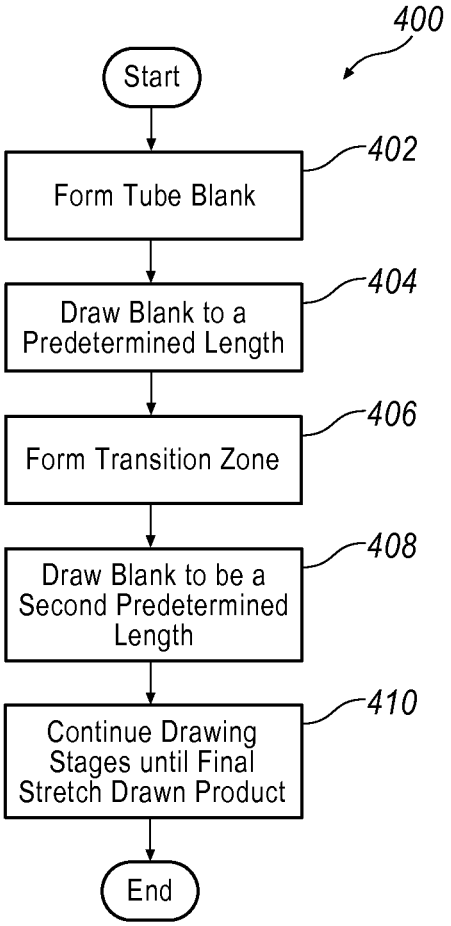
FIG. 4 illustrates an exemplary process for producing the exemplary tubular structure support of FIGS. 1 and 2.

FIG. 4 illustrates an exemplary process 400 for forming a tubular structure support 100 with variable dimensions and mechanical properties, for example wall thickness, section length, inner diameter, outer diameter, surface finish, strength or a combination thereof. The process 400 may involve working a hollow blank 200 through a working apparatus 300.

At block 402, the blank 200 material may be selected that is suitable for a particular application. The blank 200 may be formed from a single piece of material, e.g., seamless or welded, and the material may be homogeneous. The length of the blank 200 may be determined at least partially in response to the desired properties of the final structure support 100 and by the material needed to complete the drawing stages as described below. The blank 200 may include an initial inner diameter $ID_O$, an initial outer diameter $OD_O$, and an initial wall thickness $T_O$, each of which is generally constant and uniform along the length of the blank 200. The surfaces of the blank 200 may be substantially free of scale and dirt. Once the blank 200 is cut to the appropriate length, it may undergo an annealing process if the tube is welded to normalize and homogenize the weld with the rest of the blank 200 material. Annealing may also be used to allow further deformation in the later process steps. Pursuant to one implementation, the blank 200 may be coated with a lubricant to reduce friction during the multiple drawing stages. Additionally or alternatively, at least one end of the blank 200 (e.g., the first end 202 and the second end 204) may be nosed to facilitate gripping and pulling the blank 200 through the outer tool 304. The process may then proceed to block 404.

At block 404, the initial outer diameter $OD_O$ of the blank 200 is reduced by drawing the blank 200 through the working apparatus 300 to form the first section 102 of the structure support 100. The outer tool 304 of the working apparatus 300 is configured to reduce the initial outer diameter $OD_O$ of the blank 200 to the first outer diameter $OD_1$, while the inner tool 302 may have a head 306 sized to correspond to the first inner diameter $ID_1$ and is arranged in the blank 200 relative to the outer tool 304 to allow the initial inner diameter $ID_O$ of the blank 200 to conform to the outer diameter of the inner tool 302 as the blank 200 passes through the outer tool 304. The blank 200 is advanced a predetermined length, e.g., corresponding to $L_1$, to define the first section 102 having a first outer diameter $OD_1$, a first inner diameter $ID_1$ and a first wall thickness $T_1$. The process 400 then proceeds to block 406.

At block 406, the first transition zone 110 may be formed by manipulating the blank 200 in relation to the outer tool 304, e.g., via altering the angle at which the blank 200 transverses the orifice 310. Additionally or alternatively, the outer tool 304 may include a transition surface (not shown) for directing the outer wall of the blank 200 radially inward with respect to the longitudinal axis A. Pursuant to the illustrated examples, the outer surface of the first transition zone 110 may be angled to account for the differences in the outer diameter $OD_1$, $OD_2$ between the first section 102 and the second section 104, while the inner surface of the first transition zone 110 may be generally straight, e.g., forming a triangular cross-section. The process 400 then proceeds to block 408.

At block 408, the blank 200 undergoes further drawing and stretching to form the second section 104 with varying dimensions and mechanical properties. The outer tool 304 may have a reduced inner diameter corresponding to the outer diameter $OD_2$ thereby reducing the initial outer diameter $OD_O$ of the blank 200 to the outer diameter $OD_2$ of the second section 104, which according to the illustrated examples is less than the outer diameter $OD_1$ of the first section 102. As described above, the inner diameter $ID_2$ of the second section 104 may be substantially equal to the inner diameter $ID_1$ of the first section 102. However, the inner surface finish of the second section 104 may be smoother than the inner surface finish of the first section 102. Controlling the inner diameter and outer diameter of the blank 200 via the inner and outer tools 302, 304 may influence the surface finish on the interior and/or exterior surfaces of the final structure support 100, for example by forming a smoother surface finish and/or a higher dimensional accuracy. The blank 200 is advanced a second predetermined length, e.g., corresponding to $L_2$, to define the second section 104 having a second outer diameter $OD_2$, a second inner diameter $ID_2$ and a second wall thickness $T_2$. The second section 104 may have a smaller outer diameter $OD_2$ and wall thickness $T_2$ as compared to the first section 102, yet the strength of the second section 102 is stronger than the strength of the first section 102. The increase in strength of the second section 104 may be attributed to strain hardening resulting from drawing and stretching the second section 104 through an outer tool 304 with a smaller inner diameter than the outer tool 304 used to form the first section 102. That is, the strength of the structure support 100 increases as the material undergoes additional forming to shape and plastically deform the blank 200. Accordingly, the yield strength and tensile strength values of the material increase while the wall thickness may decrease. The process 400 then proceeds to block 410.

At block 410, the blank 200 may be further drawn by forming the second transition zone 112 via at least one of (A) manipulating the inner tool 302 transversely to the longitudinal axis A in relation to the blank 200 and/or the outer tool 304, and (B) manipulating the blank 200 transversely to the drawing direction in relation to the outer tool 304. Additionally or alternatively, the outer tool 304 may include a non-illustrated transition surface to force the outer surface of the blank 200 radially inwards, e.g., towards the longitudinal axis A. The outer diameter and the inner diameter of the second transition zone 112 may gradually decrease from the second section 104 to the third section 106, and thus may define rectangular cross-section.

The process 400 may continue forming the blank 200 through the working apparatus 300 to vary at least one of the inner diameter, the outer diameter and the wall thickness of subsequent sections as described above and thus define a structure support 100 with a plurality of sections having varying dimensions and mechanical properties. In the example illustrated in FIGS. 1 and 2, the process 400 continues for three more steps forming a tubular structure support 100 with four sections 102, 104, 106, 108 of dissimilar outer diameters, inner diameters, wall thickness, surface finish, section length and/or strength, and three transition zones 110, 112, 116 disposed between adjacent sections. As the blank 200 undergoes further drawing and stretching thereby reducing at least one of the inner diameter, the outer diameter and the wall thickness of a particular section, the strength of the corresponding section increases. Thus, the strength of the fourth section 108, for example, with the smallest inner diameter $ID_4$ and outer diameter $OD_4$ may be greater than the strength of the first section 102, second section 104 and third section 106. Consequently, the strength of the structure support 100 increases without sacrificing structural integrity in sections of reduced dimensions. Although the structure support 100 as illustrated in FIGS. 1-2 is described as having an outer diameter that reduces after each stage of the drawing process 400, it is also contemplated that the outer diameter of the structure support 100 does not have to decrease after each drawing and stretching stage. After the tubular structure support 100 is formed with the desired number of sections, the process 400 ends.

The structure support 100 demonstrates superior strength, dimensional accuracy, surface finish and resistance to stresses as compared to traditional structure supports, while at the same time reducing overall mass and consequently saving on the cost of materials. The superior strength, surface finish and dimensional accuracy may be derived from the drawing and stretching steps without requiring costly pre-forming and/or post-forming steps, e.g., heat treatment, machining, forging, etc. Further, the structure support 100 may be formed from a homogeneous or unitary material without having to mechanically or materially join adjacent sections. In this regard, the transition zones may provide gradual changes in dimensions between sections that may reduce stress levels in the transition zones and facilitate the reduction of the overall stress in the structure support 100. The structure support 100 may be used in any structural assembly, and may be attached by mechanical or other metal joining methods while eliminating the need for such methods within the product itself.

Accordingly, it is to be understood that the above description is intended to be illustrative and not restrictive. Many representations and applications other than the examples provided would be apparent upon reading the above description. For example, although the drawing process has been described, it is contemplated that various other forming processes such as extrusion may be used to form the structure support 100. Additionally, it is also contemplated that various stages of the forming process may be interchanged, e.g., forming the fourth section 108 with the smallest inner diameter $ID_4$ and outer diameter $OD_4$ first and sequentially expanding at least one of the inner diameter, outer diameter and wall thickness to define the first, second and third sections 102, 104, 106. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed support structure 100, apparatus 300 and methods 400 will be incorporated into such future embodiments. In sum, it should be understood that the application is capable of modification and variation.

With regard to the processes, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

All terms used in the claims are intended to be given their broadest reasonable constructions and their ordinary meanings as understood by those knowledgeable in the technologies described herein unless an explicit indication to the contrary in made herein. In particular, the use of terms such as "approximately" and "substantially" should be interpreted to account for dimensional tolerances associated with forming the structure support 100. Further, the use of the singular articles such as "a," "the," "said," etc. should be read to recite one or more of the indicated elements unless a claim recites an explicit limitation to the contrary. Additionally, the use of the words "first," "second," etc. may be interchangeable.

What is claimed is:

1. A tubular structural support, comprising:

a hollow metallic tube extending along a longitudinal axis and including two opposing ends, the tube defining an inner surface and a radially outer surface, wherein the tube is plastically deformed and defines a plurality of plastically deformed sections disposed along the longitudinal axis, the plurality of plastically deformed sections including:

a first section disposed at one end of the tube, the first section having a first inner diameter, a first outer diameter and a first wall thickness;

a second section separated from the first section via a first transition zone, the second section having a second inner diameter, a second outer diameter and a second wall thickness;

a third section remote from the first section and separated from the second section via a second transition zone, the third section having a third inner diameter, a third outer diameter and a third wall thickness;

wherein the first wall thickness is greater than the second wall thickness and the third wall thickness, the second outer diameter is less than the first outer diameter and greater than the third outer diameter, and the third inner diameter is less than the second inner diameter and the first inner diameter; and wherein the third section has a strength greater than a strength of the second section.

2. The support of claim 1, wherein the plurality of sections further include a fourth section disposed at the end of the tube opposite the first section, the fourth section having a fourth inner diameter, a fourth outer diameter and a fourth wall thickness, wherein a third transition zone is disposed between the fourth section and the third section.

3. The support of claim 2, wherein the fourth inner diameter is less than the third inner diameter and the fourth outer diameter is less than the third outer diameter.

4. The support of claim 3, wherein at least one of the fourth wall thickness is substantially equal to the third wall thickness and the fourth section has a strength greater than the strength of the third second.

5. The support of claim 1, wherein the inner surface and the outer surface of the second transition zone extend obliquely to the longitudinal axis and parallel to each other.

6. The support of claim 1, wherein the strength of the second section is greater than a strength of the first section.

7. The support of claim 1, wherein the third wall thickness of the third section is substantially equal to the second wall thickness of the second section.

8. The support of claim 1, wherein the first transition zone includes a triangular cross-section with respect to the longitudinal axis.

9. The support of claim 1, wherein the first inner diameter is substantial equal to the second inner diameter.

10. The support of claim 1, wherein the inner surface of the second section is smoother than the inner surface of the first section.

11. The support of claim 1, wherein the first section has a first length that is greater than a second length of the second section, and wherein the second length is greater than a third length of the third section.

12. A structure support for a vehicle, comprising:

a hollow metallic tube extending along a longitudinal axis and including two opposing ends, the tube defining an inner surface and a radially outer surface, wherein the tube is plastically deformed via mechanical forces to provide a plurality of plastically deformed sections disposed along the longitudinal axis, the plurality of plastically deformed sections including:

a first section disposed at one end of the tube, the first section having a first inner diameter, a first outer diameter and a first wall thickness;

a second section separated from the first section via a first transition zone, the second section having a second inner diameter, a second outer diameter and a second wall thickness;

a third section remote from the first section and separated from the second section via a second transition zone, the third section having a third inner diameter, a third outer diameter and a third wall thickness;

wherein the first wall thickness is greater than the second wall thickness and the third wall thickness, the second outer diameter is less than the first outer diameter and greater than the third outer diameter, and the third inner diameter is less than the second inner diameter and the first inner diameter; and wherein the third section has a strength greater than a strength of the second section.

13. The structure support of claim 12, wherein the strength of the second section is greater than a strength of the first section.

14. The structure support of claim 12, wherein the third wall thickness is substantially equal to the second wall thickness.

15. The structure support of claim 12, wherein the second transition zone defines a rectangular cross-section extending obliquely to the longitudinal axis, the second transition zone defining an inner diameter and an outer diameter decreasing from the second section to the third section.

16. The structure support of claim 12, wherein the first transition zone defines an inner diameter equal to the first inner diameter and the second inner diameter, the first transition zone further defining an outer diameter decreasing from the first outer diameter of the first section to the second outer diameter of the second section.

17. A method of producing a tubular support, comprising:

providing a hollow metallic blank defining an axis having a uniform initial wall thickness, a uniform initial inner diameter and a uniform initial outer diameter;

forcing the blank through an orifice of an outer tool a first length to reduce the initial outer diameter and the initial wall thickness to a first outer diameter and a first wall thickness;

forming a first transition zone by manipulating the blank with respect to the orifice of the outer tool to deform an outer surface of the blank radially inwards;

advancing the blank through the orifice of the outer tool a second length to reduce the initial outer diameter and the initial wall thickness to a second outer diameter and a second wall thickness, the second outer diameter less than the first outer diameter;

wherein forming the first transition zone by manipulating the blank with respect to the orifice of the outer tool includes pivoting the blank transversely to the axis and passing the blank obliquely through the orifice of the outer tool to transition from the first outer diameter to the second outer diameter;

wherein the first transition zone is disposed between the first length and the second length.

18. The method of claim 17, further comprising mechanically varying the initial inner diameter and the initial outer diameter of the blank to form a second transition zone, wherein mechanically varying the initial inner diameter and the initial outer diameter includes manipulating an inner tool positioned within the blank transversely to the axis and pivoting the blank transversely to the axis while the blank advances through the orifice of the outer tool.

* * * * *